US006336013B1

(12) United States Patent
Suda et al.

(10) Patent No.: US 6,336,013 B1
(45) Date of Patent: Jan. 1, 2002

(54) IMAGE FORMING APPARATUS AND PROCESS CARTRIDGE HAVING MAGNET TO PREVENT TONER SCATTERING

(75) Inventors: Takeo Suda, Tokyo; Hiroshi Yoshinaga, Ichikawa, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/546,656

(22) Filed: Apr. 10, 2000

(30) Foreign Application Priority Data

Apr. 9, 1999 (JP) ..... 11-102466
Mar. 10, 2000 (JP) ..... 12-066069

(51) Int. Cl.[7] ..... G03G 15/08; G03G 15/09
(52) U.S. Cl. ..... 399/103; 399/104
(58) Field of Search ..... 399/102, 103, 399/104, 105, 106, 98, 111, 119; 430/120

(56) References Cited

U.S. PATENT DOCUMENTS 4,338,880 A * 7/1982 Tabuchi et al. ..... 399/103
4,469,427 A * 9/1984 Kopp et al. ..... 399/103
4,615,608 A * 10/1986 Mizutani ..... 399/103
4,676,191 A * 6/1987 Kojima et al. ..... 399/104
5,887,224 A 3/1999 Mizuishi et al. ..... 399/62
5,915,143 A 6/1999 Watanabe et al. ..... 399/44
6,144,820 A * 11/2000 Ishii et al. ..... 399/103 X
6,256,465 B1 * 7/2001 Yoshinaga et al. ..... 399/103

FOREIGN PATENT DOCUMENTS

| | | |
|---|---|---|
| JP | 7-175320 | 7/1995 |
| JP | 8-62976 | 3/1996 |
| JP | 9-50188 | 2/1997 |
| JP | 11-265118 | 9/1999 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An electrophotographic image forming apparatus using a magnetic toner as a developer includes an image carrier and a case housing a developing roller to develop a latent image on the image carrier with the developer. A magnet is provided to a portion of the case adjacent to a surface of the image carrier after development of the latent image and before transfer of the developed image.

13 Claims, 15 Drawing Sheets

IMAGE FORMING APPARATUS AND PROCESS CARTRIDGE HAVING MAGNET TO PREVENT TONER SCATTERING

BACKGROUND OF THE INVENTION

1. Field of the Invention

The present invention relates to an electrophotographic image forming apparatus such as a copying machine, a printer, a facsimile or a composite machine thereof, in which charging, optical writing, development, transfer, cleaning or the like are sequentially repeated to form toner images on an image carrier and transfer the toner images onto transfer material such as paper, cards or the like. The invention further relates to a process cartridge used in such an electrophotographic image forming apparatus.

2. Discussion of the Background

There are known image forming apparatuses in which, for example, as illustrated in FIG. 10, a process cartridge 1 housing an image carrier 3 and a developing device 4 in a cartridge case 2 is detachably mounted in a body of the apparatuses.

The developing device 4 includes a developing roller 5 and a developer storage portion 6 storing a magnetic toner as a one component developer. The magnetic toner adhered to the developing roller 3 is applied to an electrostatic latent image on the image carrier 5 with the developing roller 5 and thereby the latent image is developed into a toner image. The toner image formed on the image carrier 3 is transferred, by a transfer roller 7, to a transfer material p timely delivered by resist rollers 8.

In the image forming apparatus as described above, as illustrated in FIG. 11, the distance h between the peripheral surface of the developing roller 5 and the upper surface of a bottom portion 2*a* of the cartridge case 2 is set to be on the order of 1.5 to 2 mm, and the magnetic toner passing therebetween is held by the magnetic force of the developing roller 5. Therefore, generally, the toner in the developer storage portion 6 rarely passes between the peripheral surface of the developing roller 5 and the upper surface of the bottom portion 2*a* of the cartridge case 2 to adhere to a case portion 2*b* close to the surface of the image carrier 3 after development of a latent image and before transfer of the developed image.

However, as illustrated in FIG. 12, there exists a problem that a toner t scattered from the surface of the image carrier 3 or the surface of the developing roller 5 is adhered to the case portion 2*b* and is formed into a lump. The toner lump is removed by some chance to fly out of the cartridge case 2 and thereby contaminates the transfer material p. Further, when the user's hand touches the case portion 2*b* for taking out the process cartridge 1, the toner adhered to the case portion 2*b* contaminates the hands.

Because of the above-described problem, among the known image forming apparatuses, there is an apparatus in which for example, as illustrated in FIG. 13, a conductive member 9 is provided such that the whole surface of the inner surface of the case portion 2*b* is covered by the conductive member 9, and a voltage of the same polarity as the charging polarity of the magnetic toner is applied to the conductive member 9. The conductive member 9 is provided in parallel with the developing roller 5, for example, as illustrated in FIG. 14. Further, both ends 9*a* thereof are pulled outside the cartridge case 2 and are superposed on the outer surface of the cartridge case 2, and are electrically connected to a roller shaft 5*a* of the developing roller 5 through a plate spring-like conductive terminal member m.

However, even when the apparatus has such an arrangement as described above, it is difficult to completely prevent the toner t from adhering to the conductive member 9. Further, there sometimes occurs an inconvenience such as that illustrated in FIG. 15, wherein the toner t is adhered to the case portion 2*b* round the conductive member 9 to contaminate the transfer material p or hands when the process cartridge 1 is taken out by the hands.

SUMMARY OF THE INVENTION

The present invention has been made in view of the above-discussed and other problems and addresses the above-discussed and other problems.

Preferred embodiments of the present invention provide a novel process cartridge and a novel image forming apparatus that eliminate the possibility of contaminating the transfer material and hands by the scattered toner.

According to a preferred embodiment of the present invention, an electrophotographic image forming apparatus using a magnetic toner as a developer includes an image carrier and a case housing a developing roller to develop a latent image on the image carrier with the developer. A magnet is provided to a portion of the case adjacent to the surface of the image carrier after development of the latent image and before transfer of the developed image.

The case portion to which the magnet is provided may be part of a cartridge case of a process cartridge, or may be part of a developing case of a developing device, or may be part of the other components of the apparatus.

In the above-described electrophotographic image forming apparatus, the case portion may be made closer to the image carrier than to the developing roller.

Also, in the above-described electrophotographic image forming apparatus, the magnet may be provided to the case portion through a conductive member and a voltage of the same polarity as that of the developer may be applied to the conductive member. Further, the magnet may be provided so that a range in which the magnet can hold the developer ranges from 0.5 to 3 mm from the tip end of the conductive member on the image carrier side.

Further, in the above described electrophotographic image forming apparatus, when the shortest distance between the developer holding range of the magnet and the image carrier is X and the moving linear velocity of the image carrier is Y, the following relation is established; $X \geqq Y/100$.

Furthermore, in the above-described electrophotographic image forming apparatus, the shortest distance between the developer holding range of the magnet and the image carrier may be not less than 1.0 mm.

According to another preferred embodiment of the present invention, an electrophotographic image forming apparatus using a magnetic toner as a developer includes an image carrier and a case housing a developing roller to develop a latent image on the image carrier with the developer. A conductive member is provided to the developing roller side of a portion of the case adjacent to the surface of the image carrier after development of the latent image and before transfer of the developed image, projecting closer to the image carrier than the case portion, and a voltage of the same polarity as that of the developer is applied to the conductive member.

In the electrophotographic image forming apparatus described immediately above, a non-conductive member may be provided to the case portion side of the conductive member so as to overlap with the conductive member. Further, the overlapped conductive and non-conductive members may be made such that the portion of the overlapped conductive and non-conductive members protruding from the case portion is bent by 1 mm with the bending force being not less than 20 gf/cm when a transfer material comes in contact with the non-conductive member.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein:

FIG. 14 is a partially perspective view of the process cartridge in the known laser printer; and.

DESCRIPTION OF THE PREFERRED EMBODIMENTS

Figure 1:
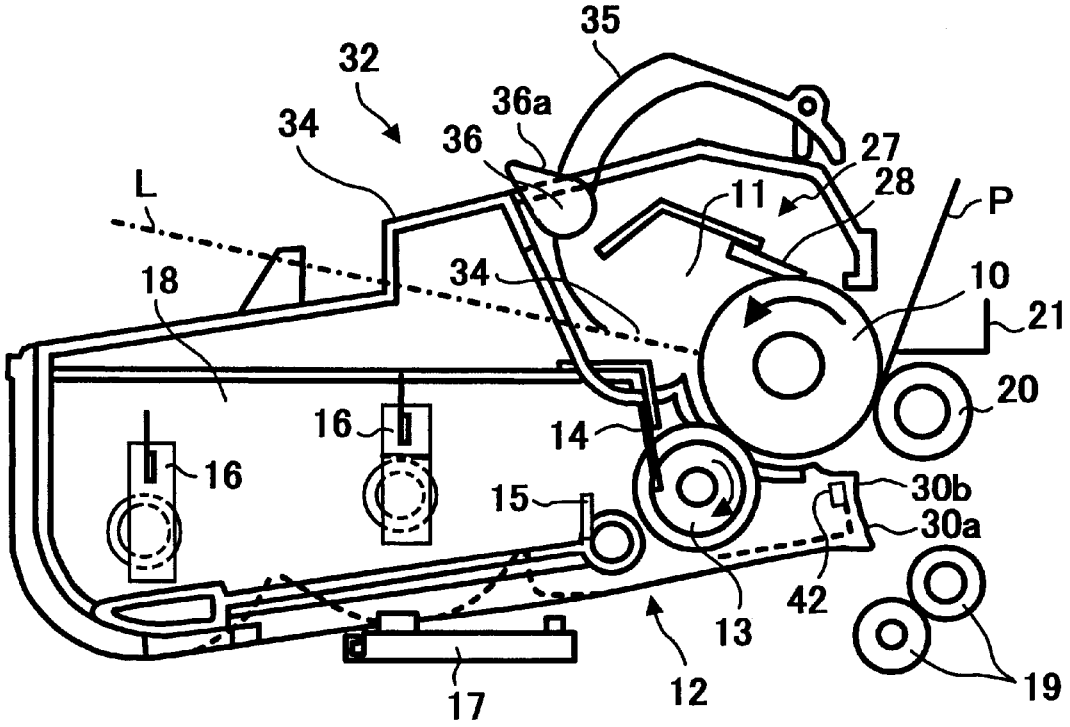
FIG. 1 is a schematic view of main parts of a laser printer according to an embodiment of the present invention.

Referring now to the drawings, wherein like reference numerals designate identical or corresponding parts throughout the several views, preferred embodiments of the present invention are described.

FIG. 1 illustrates a schematic constitution of main parts of a laser printer according to an embodiment of the present invention. In FIG. 1, reference numeral 10 designates a drum-like image carrier provided inside of a body of the printer. In the figure, the right side is a front side portion of the printer body.

When forming an image, the image carrier 10 is rotated in the direction indicated by arrow (i.e. counterclockwise) in the figure. First, the surface of the image carrier 10 is uniformly charged by a charging roller 11, and then, optical writing is carried out by irradiating a laser beam L from an optical writing device (not shown) to form an electrostatic latent image on the surface of the image carrier 10.

A developing device 12 provided around the image carrier 10 is provided with a developing roller 13, and one component developer is stored in a developer storage portion 18. A developing bias voltage in which an AC component and a DC component are superposed is applied to the developing roller 13 from a power supply (not shown), so that a magnetic toner as one component developer, which is carried on the developing roller 13, is adhered onto the electrostatic latent image formed on the surface of the image carrier 10, interdependently with the electrostatic attraction of the latent image.

With the rotation of the image carrier 10, the magnetic toner is adhered to the latent image on the surface of the image carrier 10 by the developing roller 13 of the developing device 12 to develop the latent image on the image carrier 10. The developing device 12 is provided with a developing blade 14, which is in frictional contact with the developing roller 13 to frictionally charge the toner, an agitating shaft 15 and an agitator 16 for agitating and conveying the toner, and a toner end sensor 17 for detecting the remaining quantity of toner within the developing device 12.

Further, with the rotation of the image carrier 10, sheet-like transfer materials contained in a feed cassette (not shown) are sequentially delivered sheet by sheet to impinge upon and stop at a pair of resist rollers 19. The paired resist rollers 19 are rotated at a timing so adjusted to make a leading edge of a transfer material P register with the image on the image carrier 10, and the transfer material P is guided by a part 30*a* of the outer surface of a cartridge 30 and delivered to a transfer nip between the image carrier 10 and a transfer roller 20. A toner image on the image carrier 10 is then transferred to the transfer material P by the transfer roller 20.

The transfer material P after transferring an image is discharged by a discharging needle 21, after which the transfer material P is conveyed upward through a conveying route and to a fixing nip between a fixing roller and a pressing roller of a fixing device (not shown), where heat and pressure are applied to the transfer material P to fix the transferred image on the transfer material P. Thereafter, the transfer material P is discharged to a sheet discharge portion with the image surface thereof directed down.

After transfer of an image, with the rotation the image carrier 10, a residual toner is removed from the surface of the image carrier 10 by a cleaning blade 28 of a cleaning device 27 for re-charging by the charging roller 11 for subsequent image formation.

The image forming conditions of the laser printer are set in this embodiment as follows: the charge potential (a white-part potential) on the image carrier 10 at −750 (V); the exposure-portion potential (a black-part potential) at −100 (V); the AC component of the superposed bias voltage for development at −1.8 (kV) and the DC component at −600 (V); the transfer current at +12 ($\mu$A); and the image-carrier linear velocity at 100 mm/sec.

In the laser printer illustrated in FIG. 1, the aforementioned image carrier 10, the charging roller 11, the developing device 12, the cleaning device 27 are housed in a cartridge case 30 which is a single case, constituting a process cartridge 32. With this configuration, the accuracy of relative position between each component is enhanced, and the body of the printer as an image forming apparatus is made relatively compact. Further, the parts of the process cartridge 32 can be collectively replaced without performing separately, thus facilitating handling and recording of the replacement and simplifying the maintenance work.

The process cartridge 32 is provided with an image carrier shutter 35, which is supported by the cartridge case 30 and which is freely closed and opened about a support shaft 34. The shutter is biased in a closing direction by a spring (not shown). With the above-described configuration, when a front cover of the printer body is opened, while the transfer roller 20 supported by the front cover is separated from the image carrier 10, the image carrier shutter 35 is closed by the bias force of the above spring into contact with a member (not shown) to assume a protective position for covering the image carrier 10.

When the front cover of the body is closed, a lever portion provided on the front cover pushes a striking surface 36*a* of a striking portion 36 to open the image carrier shutter 35 around the support shaft 34 against the bias force to form the conveying route to convey the transfer material P after transfer of an image toward the fixing device and to move the image carrier shutter 35 to a withdrawing position at which the image carrier 10 is uncovered.

In the laser printer as described above, when a black solid image to which much toner is adhered is printed or when a large number of prints are made, much toner scatters and adheres to the case portion 30*b* of the cartridge case 30 which is close to the surface of the image carrier 10 after development of a latent image and before transfer of the developed image. In the example illustrated in FIG. 1, the case portion 30*b* is spaced 2 mm from the image carrier 10 and by 14 mm from the developing roller 13, and thus the case portion 30*b* is positioned more closer to the image carrier 10 than to the developing roller 13.

Figure 2:
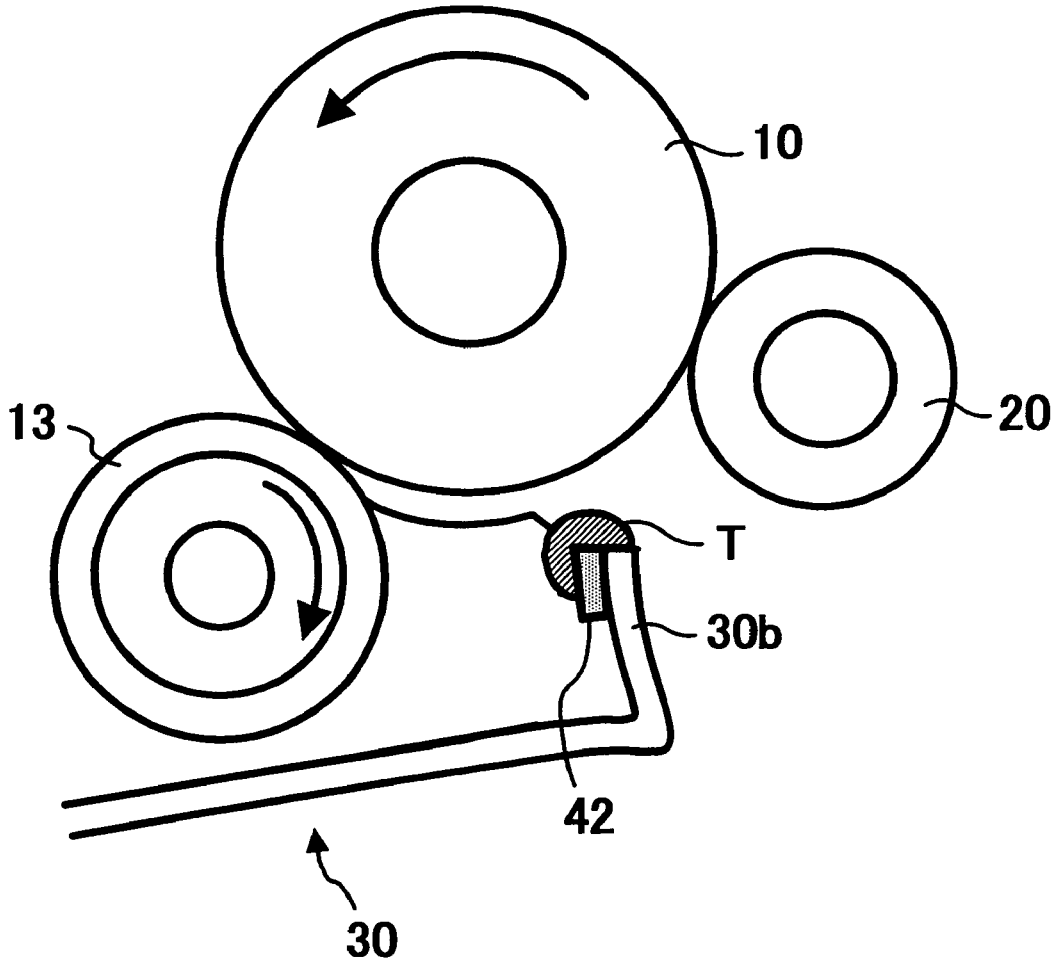
FIG. 2 is a partially enlarged view of a process cartridge of the laser printer, illustrating the state of holding a floating toner by a magnet provided to a portion of a case of the process cartridge.

In this embodiment, a magnet 42 whose magnetic flux density is 50±5 mT is pasted on the inner surface of the case portion 30*b*. A floating toner T scattered from the image carrier 10 or the developing roller 13 is magnetically held by the magnetic force of the magnet 42, as illustrated in FIG. 2, and thereby the toner is prevented from scattering again to the image carrier 10 so as to lower the quality of an image, and also, the toner adhered to the case portion 30*b* is prevented from forming a lump which may fly out of the cartridge case 30.

However, when much toner is adhered to the magnet 42, there is a possibility that the toner cannot be held merely by the magnetic force of the magnet 42. Therefore, it is preferable that for example, as illustrated in FIG. 3, the magnet 42 is provided on the case portion 30*b* through a sheet-like conductive member 40 and a voltage of the same polarity as that of the magnetic toner is applied to the conductive member 40 to prevent much toner from flying toward the magnet 42.

The conductive member 40 has volume resistance of $10^6$ (Ωcm), for example. However, the volume resistance may be any in the range from $10^1$ to $10^9$ (Ωcm).

Figure 4:
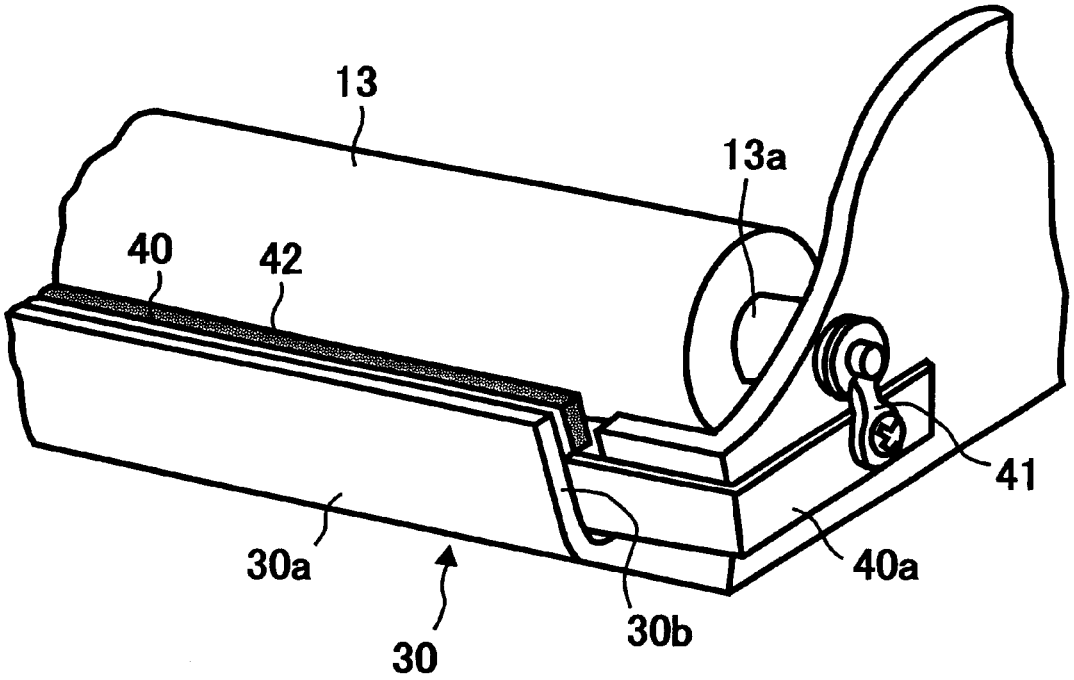
FIG. 4 is a partial perspective view of the case portion of the process cartridge, to which a magnet is provided through a conductive member.

The conductive member 40 is provided in parallel with the developing roller 13, for example, as illustrated in FIG. 4. Both ends 40*a* of the conductive member 40 are pulled out outside the cartridge case 30 are superposed on the outer surface of the cartridge case 30, and are electrically connected to a roller shaft 13*a* of the developing roller 13 through a plate spring-like conductive terminal member 41. A bias voltage of the same polarity as that of a developing bias voltage applied to the developing roller 13, in which a DC component and an AC component are superposed, that is, a voltage of the same polarity as that of the developer, is applied to the conductive member 40.

Figure 3:
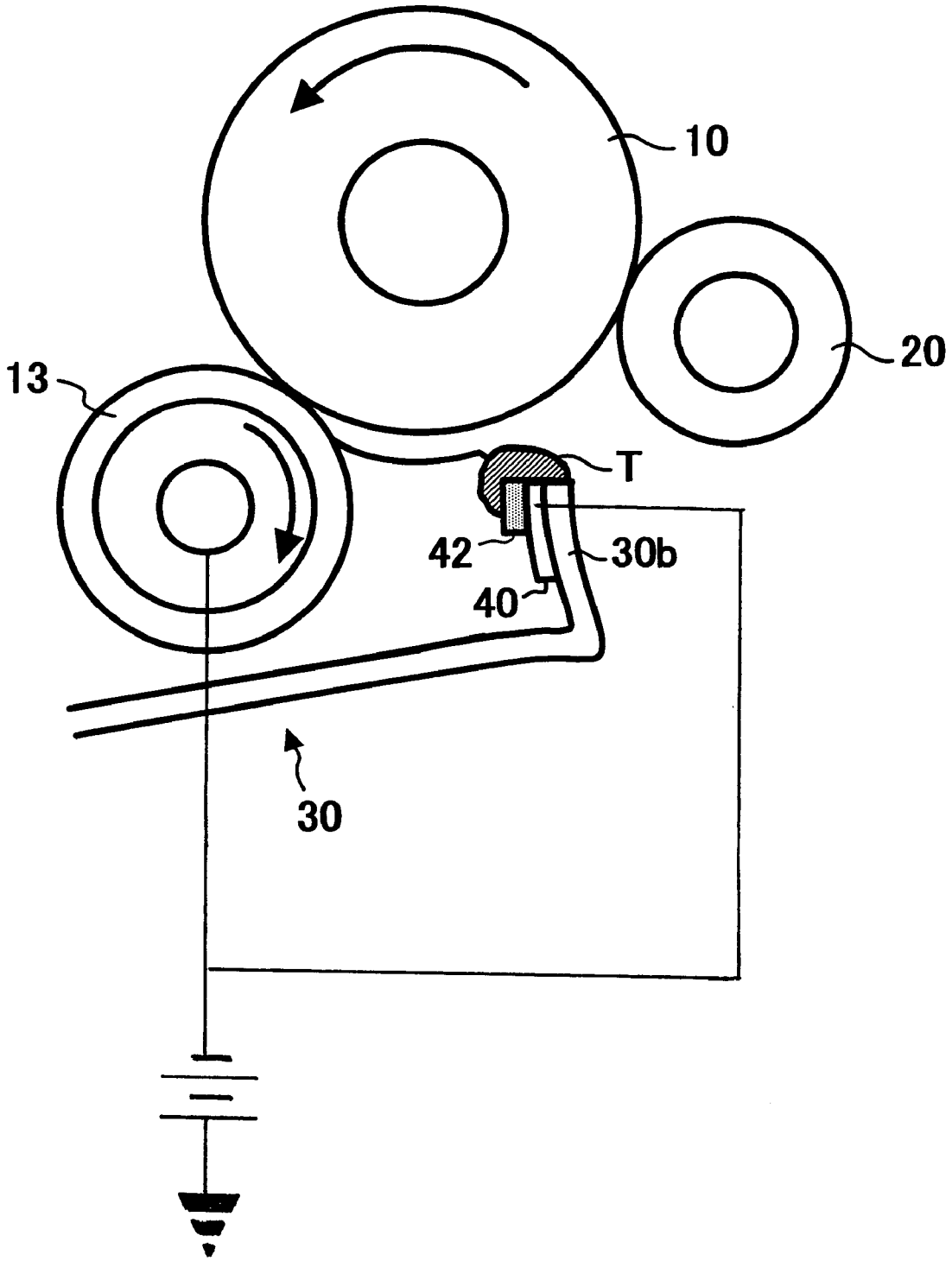
FIG. 3 is another partially enlarged view of the process cartridge of the laser printer, illustrating the state of holding a floating toner by a magnet provided to a portion of the case of the process cartridge through a conductive member.
Figure 5:
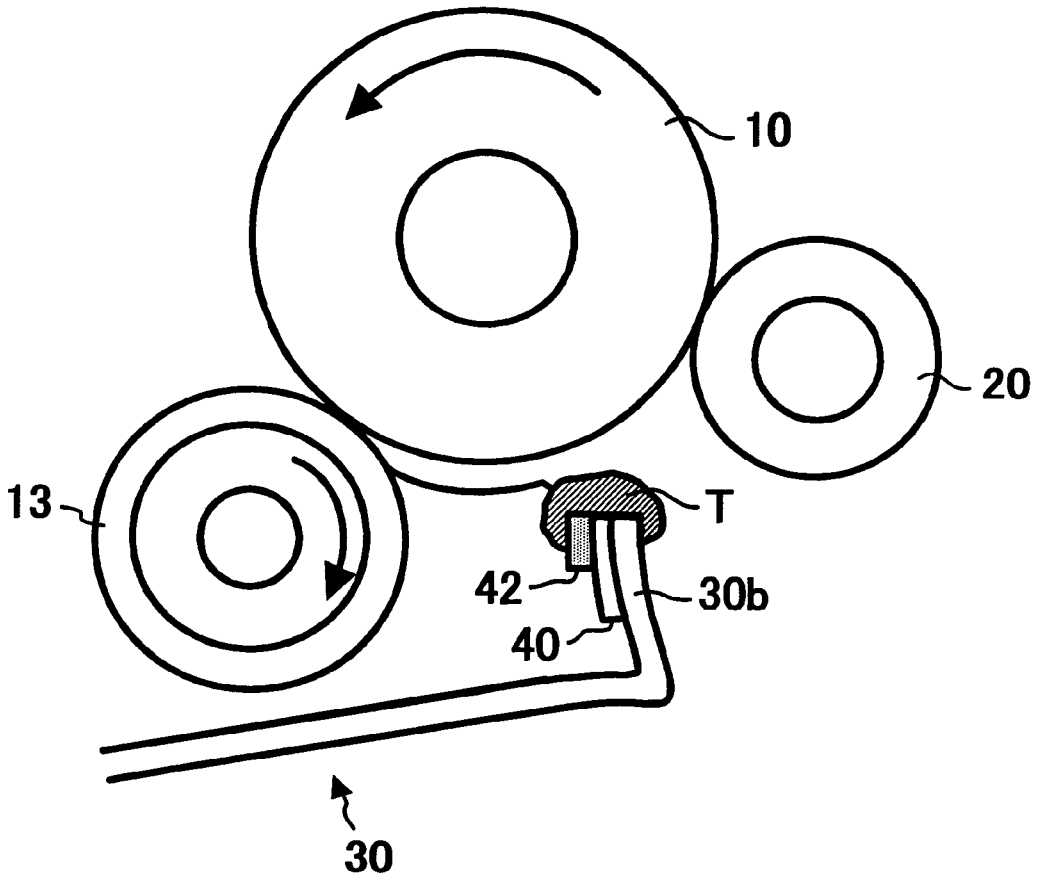
FIG. 5 is an explanatory view of a state that a toner held by a magnet is moved round the surface of the case portion.

However, when the magnet 42 is provided near the tip end of the conductive member 40, as illustrated in FIGS. 3 and 4, the toner T adhered to the magnet 42 gradually increases, so that, as illustrated in FIG. 5, the toner is moved toward the front surface side of the case portion 30*b*, which may possibly contaminate the transfer material P and may further contaminate the hands of the user touching the case portion 30*b* in order to take out the process cartridge 32.

For preventing the above movement of the toner toward the front surface side of the case portion 30*b*, the magnet 42 may be mounted to the conductive member 40 such that a range "a" (see FIG. 6) capable of holding a magnetic toner ranges from 0.5 to 3 mm, including a tolerance of adhesion, from the tip end of the conductive member 40 at the side of the image carrier 10. With this arrangement, the toner held by the magnet 42 is prevented from moving round the surface side of the case portion 30*b* as illustrated in FIG. 5.

According to an experiment, when the magnetic toner holding area a is set in the area not more than 0.5 mm from the tip end of the conductive member 40, when several thousand sheets are printed, the toner is adhered to the conductive member 40, which then, in turn, is adhered to the transfer material P so as to lower the quality of an image. When the magnetic toner holding area a ranges from 0.5 to 3 mm from the tip end of the conductive member 40, on the other hand, the toner did not adhere to the conductive member 40. Further, when the range a is set in the range 3 mm or more from the tip end of the conductive member 40, the contamination of images occurred in several hundred prints.

Figure 6:
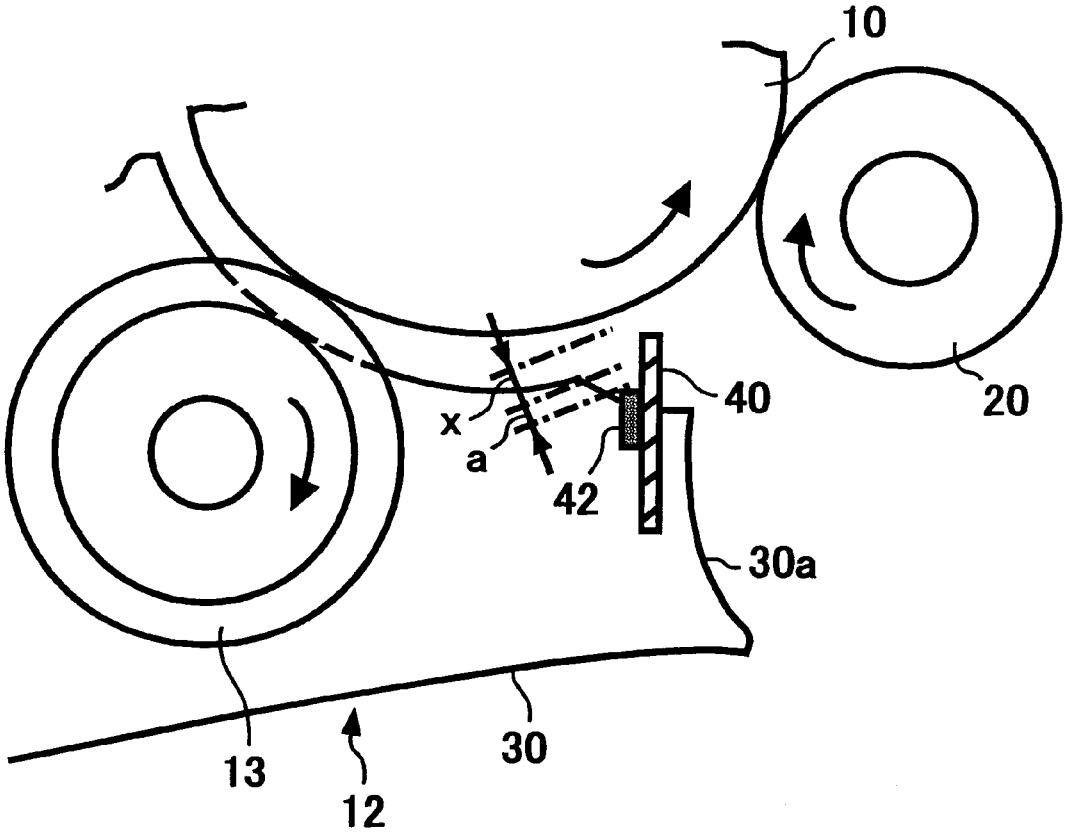
FIG. 6 is a partially enlarged view of the process cartridge of the laser printer according to another embodiment of the present invention.

In the laser printer described above, when the shortest distance between the magnetic toner holding range a and the image carrier 10 is X, as illustrated in FIG. 6, the value of X may be preferably set in the range from 1.5 to 3 mm. When the value of X is not more than 1 mm, the toner magnetically held by the magnet 42 scatters again to the image carrier 10 due to an air current caused by the rotation of the image carrier 10 to possibly lower the quality of an image.

The relation between the shortest distance X and the moving linear velocity Y of the image carrier 10 may be set to $X \geqq Y/100$. It has been confirmed as the result of experiments that with the relation set as described above, there is no possibility that the toner magnetically held by the magnet 42 scatters again to the image carrier 10 due to an air current caused by the rotation of the image carrier 10 to lower the quality of image.

It has been further confirmed as the result of experiments that, when the linear velocity of the image carrier 10 is not more than 100 mm/sec, if the distance X is less than 1.0 mm, the contamination of granular toner occurs irrespective of the linear velocity. Therefore, the shortest distance X between the magnetic toner holding range a and the image carrier 10 is preferably set to 1.0 mm or more.

In the example illustrated in FIG. 6, the conductive member 40 is provided so as to be projected closer to the image carrier 10 than the case portion 30*b*. When the conductive member 40 is provided so as to be projected closer to the image carrier 10 than the case portion 30*b* as described, it is possible to prevent the toner held by the magnet 42 from getting over the conductive member 40 to move toward the front surface side of the case portion 30*b*, so that the toner is hard to adhere to the front surface side of the case portion 30*b*.

Figure 7:
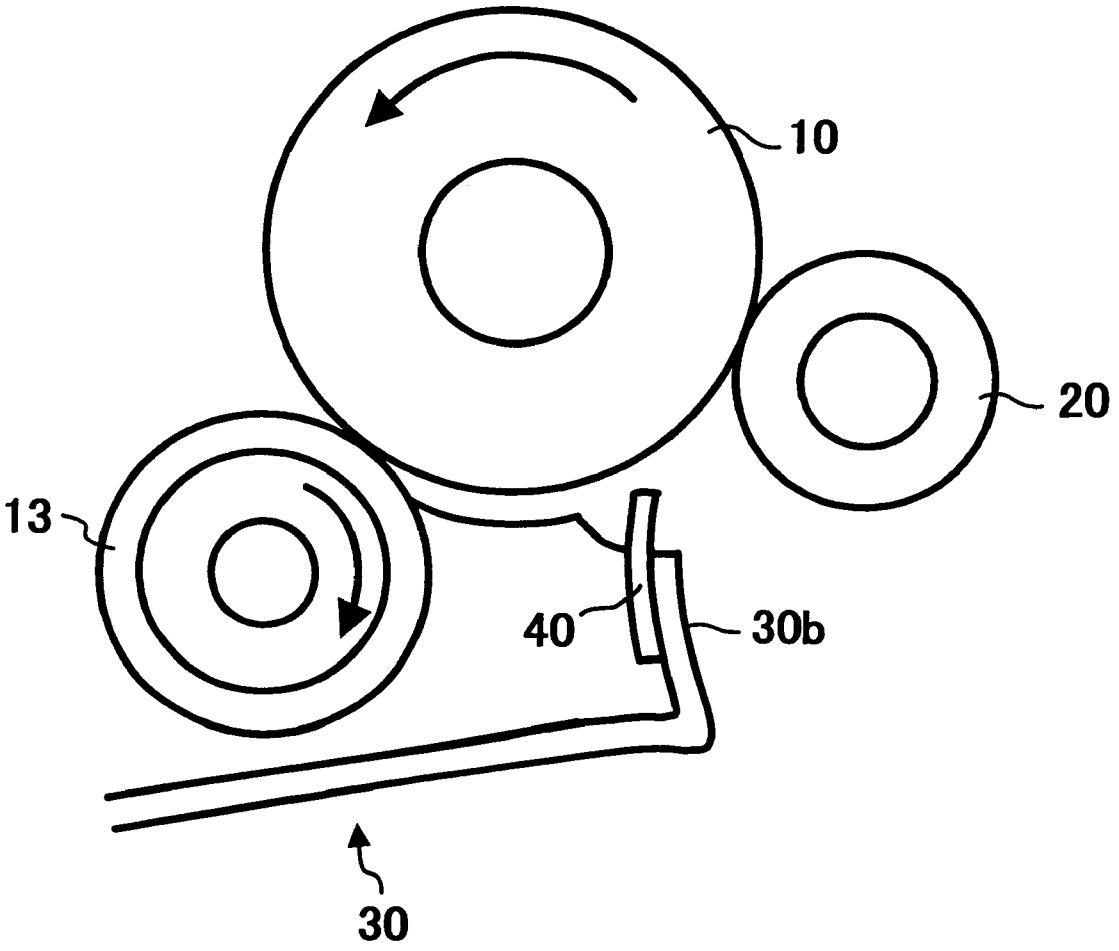
FIG. 7 is a partially enlarged view of the process cartridge according to still another embodiment.

In the laser printer described above, the magnet 42 is provided on the case portion 30*b* close to the surface of the image carrier 10 after development of a latent image and before transfer of the developed image in order to positively eliminate the possibility of contaminating the transfer material and contaminating the hands of the user due to the scattered toner. However, as illustrated in FIG. 7, it is also possible to satisfactorily eliminate the possibility of contaminating the transfer material and the hands, without providing the magnet 42, merely by providing the conductive member 40 to the developing roller 13 side of the case portion 30*b* located close to the surface of the image carrier 10 after development and before transfer of the image, so as to project closer to the image carrier 10 than the case portion 30*b*, and applying a voltage of the same polarity as that of the developer to the conductive member 40.

When the conductive member 40 is provided so as to be projected from the case portion 30*b* as described above, however, the transfer material P conveyed to the transfer nip while being guided by a part 30*a* of the outer surface of the cartridge case 30 may come in contact with or close to the conductive member 40. By contacting the conductive member 40, the transfer material P may be charged with the same polarity as the developing bias voltage, so as to have an uneven charge, and thereby, when an image is transferred, an unevenness of transfer may be produced so as to scatter toner and to lower the quality of the image.

Particularly, when the developing bias voltage is a voltage having a DC component superposed on a AC component, as described above, a peak voltage of the AC component is often set to approximately 500 to 3000 (V), and occurrence of an abnormal image due to this voltage is notable.

Figure 8:
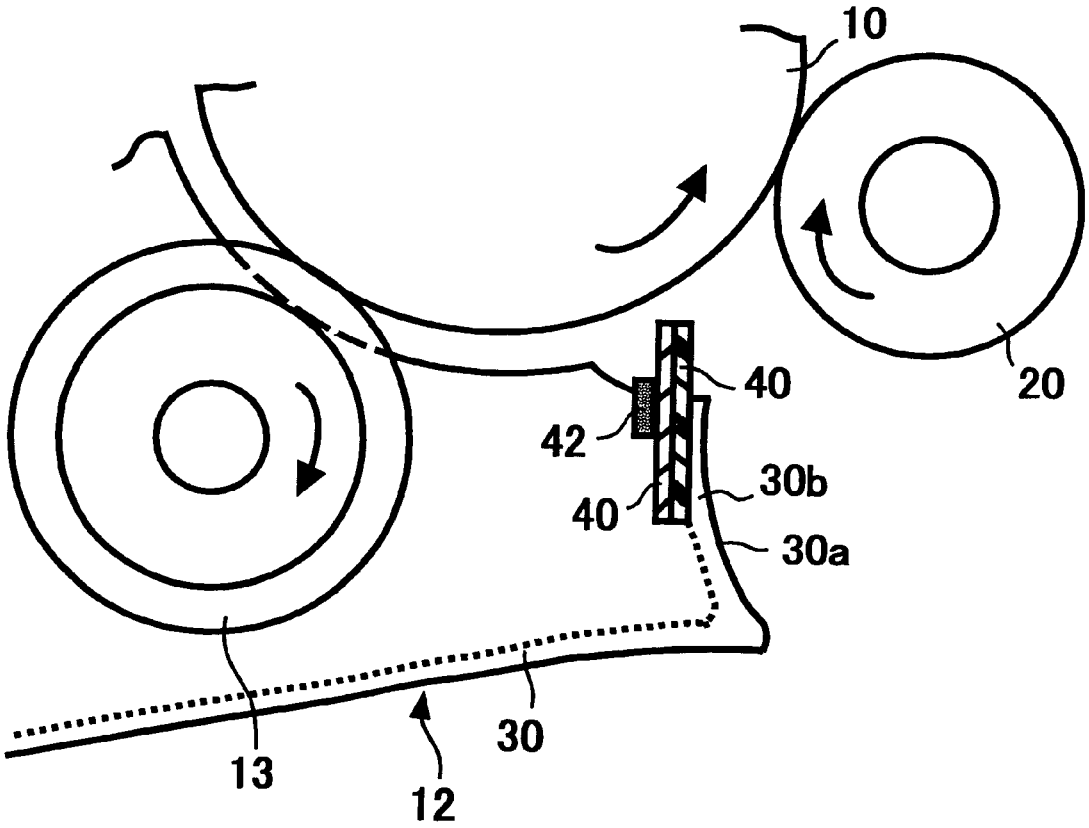
FIG. 8 is a partially enlarged view of the process cartridge according to still another embodiment.

Therefore, as illustrated in FIG. 8, a sheet-like non-conductive member 44 is preferably adhered to the case portion 30*b* side of the sheet-like conductive member 40 to overlap with each other constituting two-layers, such that the transfer material P does not come in contact with or close to the conductive member 40 by being interrupted by the non-conductive member 44. With this configuration, no unnecessary charge is applied to the transfer material P, and thereby the occurrence of an unevenness in transfer is prevented, particularly when the transfer material P has been processed for surface treatment and which thereby tends to generate charge.

For the non-conducive member 44, for example, PET (polyethylene terephthalate), which is 0.2 mm thick, is used.

Further, in the laser printer illustrated in FIG. 8, the overlapped sheet-like conductive and non-conductive members 40, 44 may be made such that the portion of the overlapped conductive and non-conductive members 40, 44, which are formed in two layers and protruding from the case portion 30*b*, is bent by 1 mm with a bending force of 20 gf/cm or more, when the transfer material P comes in contact with the non-conductive member 44.

When only the conductive member 40 is arranged as illustrated in FIG. 7, the conductive member 40 is bent by 1 mm with a bending force of 10 gf/cm. In this case, when the conductive member 40 is bent by the transfer material P and then restored, toner is floated and scattered by the reaction of the conductive member 40.

When the bending force is 20 gf/cm or more, it is possible to relatively lessen the contamination of toner caused by scattering due to the reaction of the conductive member 40 or the overlapped conductive and non-conductive members 40, 44. The greater the bending force is, the contamination of toner can be lessened. Preferably, the bending force is 50 gf/cm or more.

Figure 9:
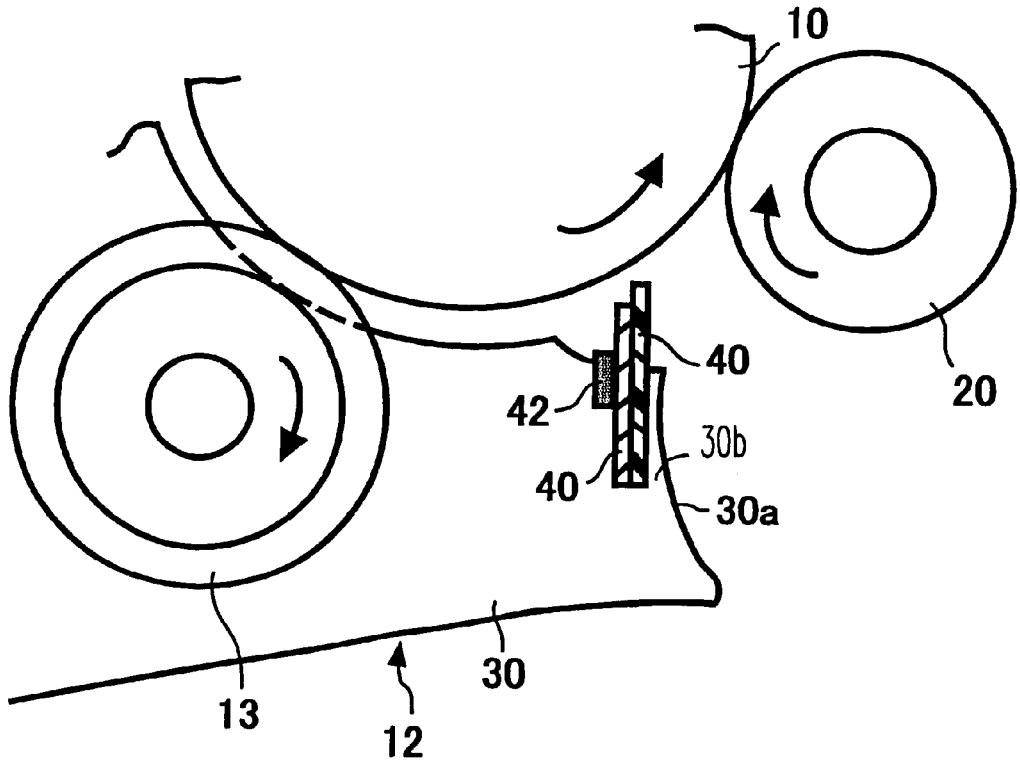
FIG. 9 is a partially enlarged view of the process cartridge according to yet another embodiment of the present invention.
Figure 10:
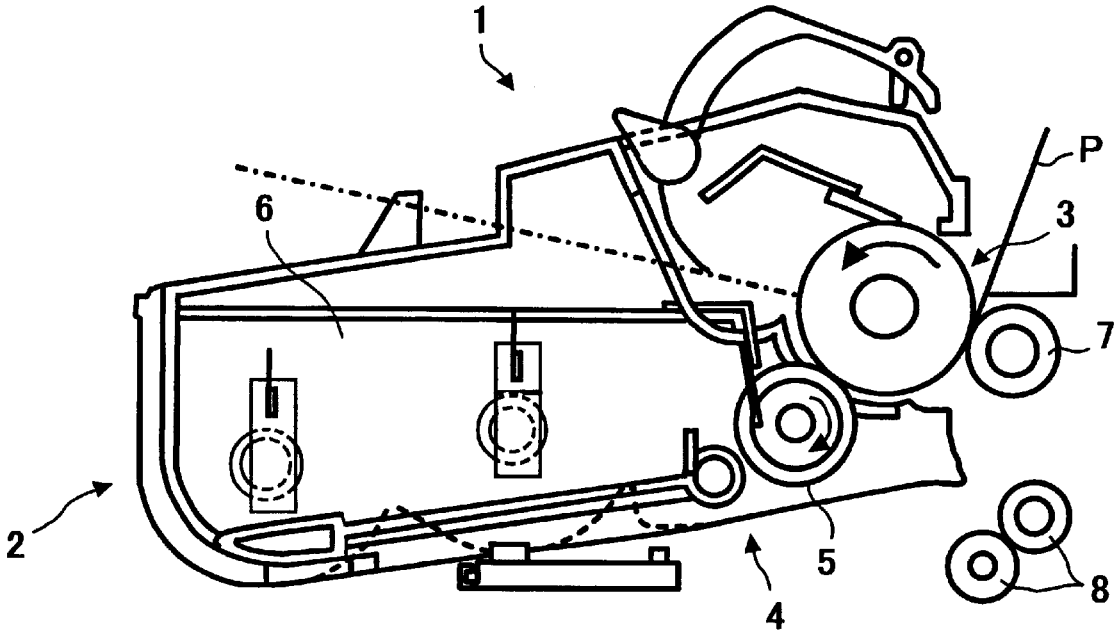
FIG. 10 PRIOR ART
FIG. 10 is a schematic view of a known laser printer.
Figure 11:
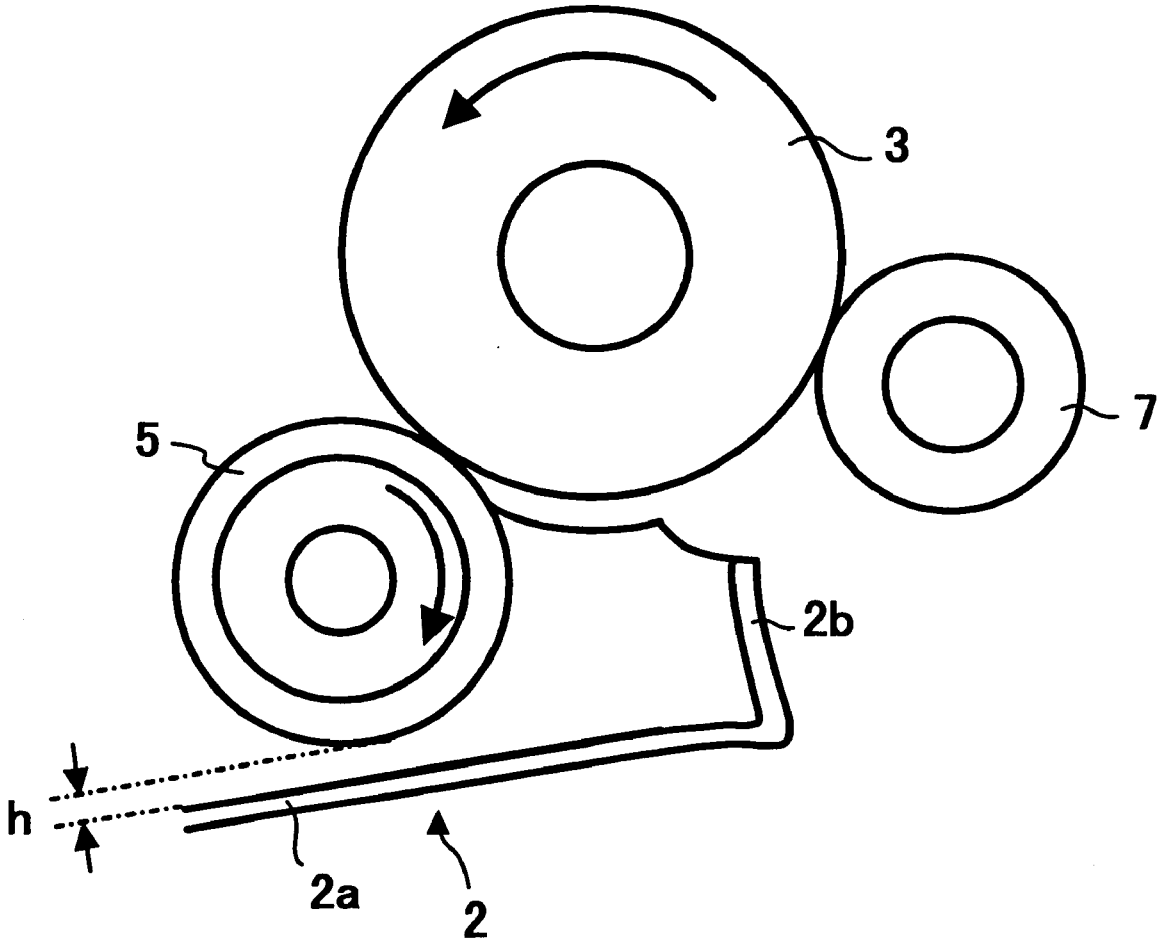
FIG. 11 PRIOR ART
FIG. 11 is a partially enlarged view of a process cartridge of the known laser printer.
Figure 12:
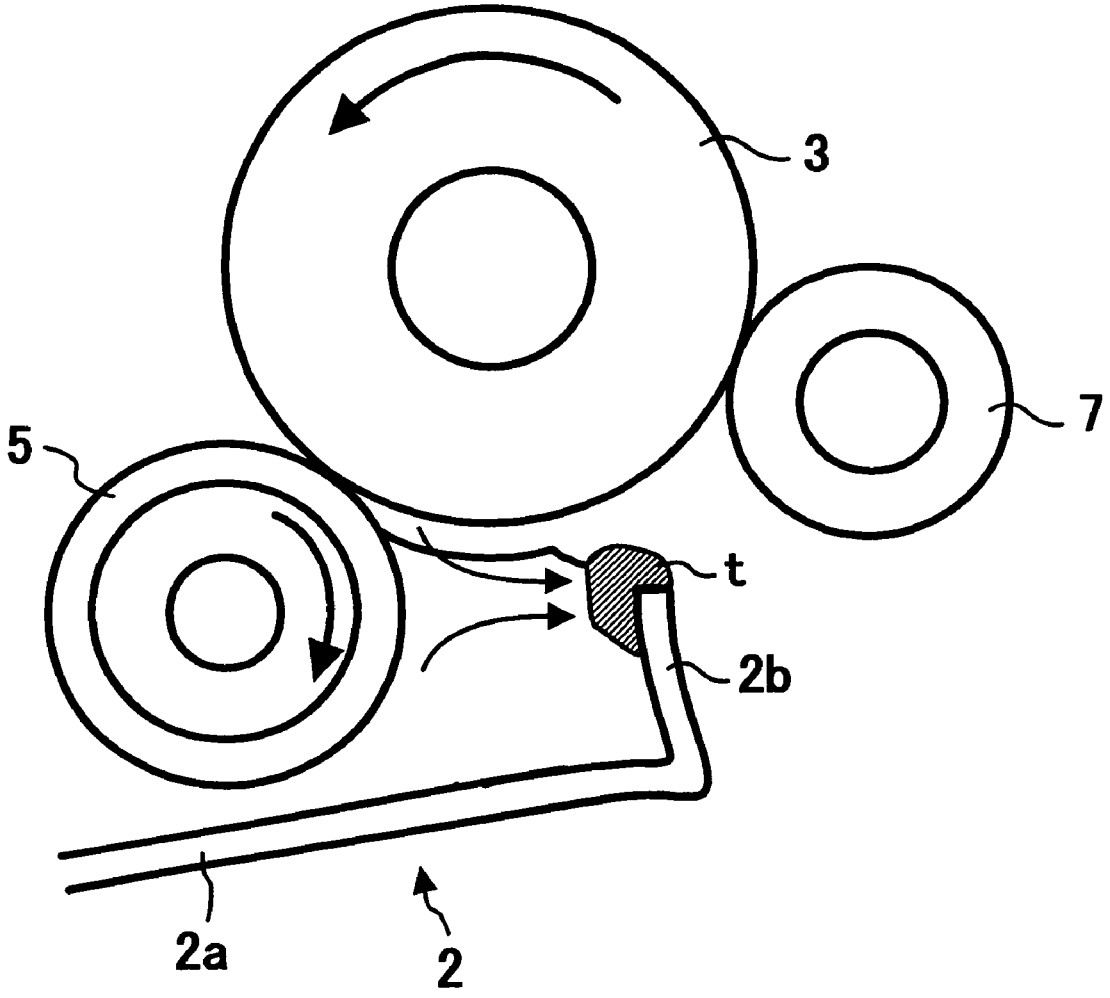
FIG. 12 PRIOR ART
FIG. 12 is an explanatory view of a state wherein a toner is adhered to a case portion of the process cartridge of the known laser printer.
Figure 13:
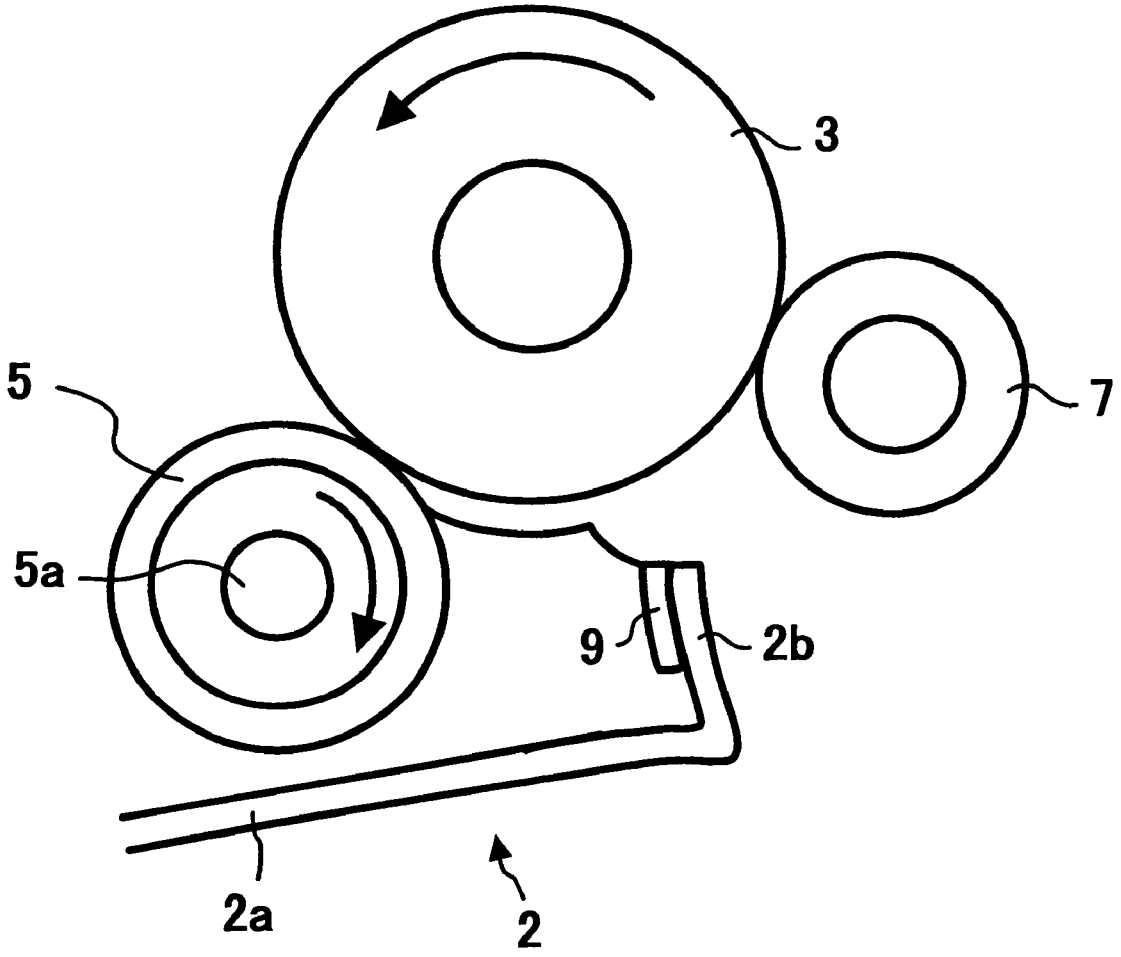
FIG. 13 PRIOR ART
FIG. 13 is another partially enlarged view of the process cartridge in the known laser printer.
Figure 14:
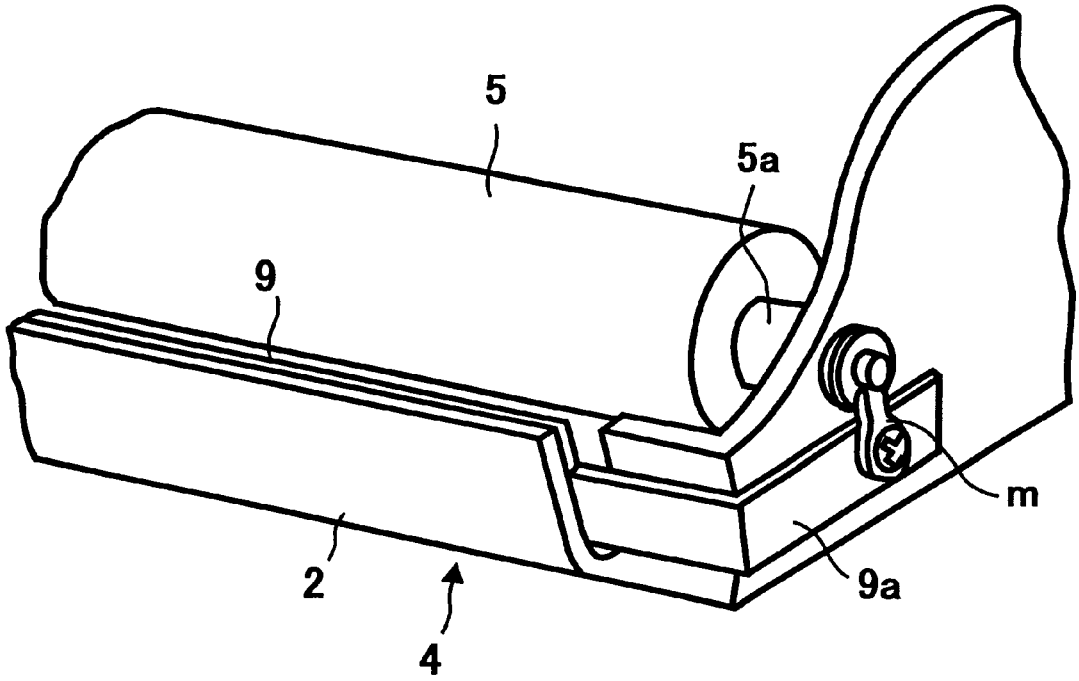
FIG. 14 PRIOR ART
Figure 15:
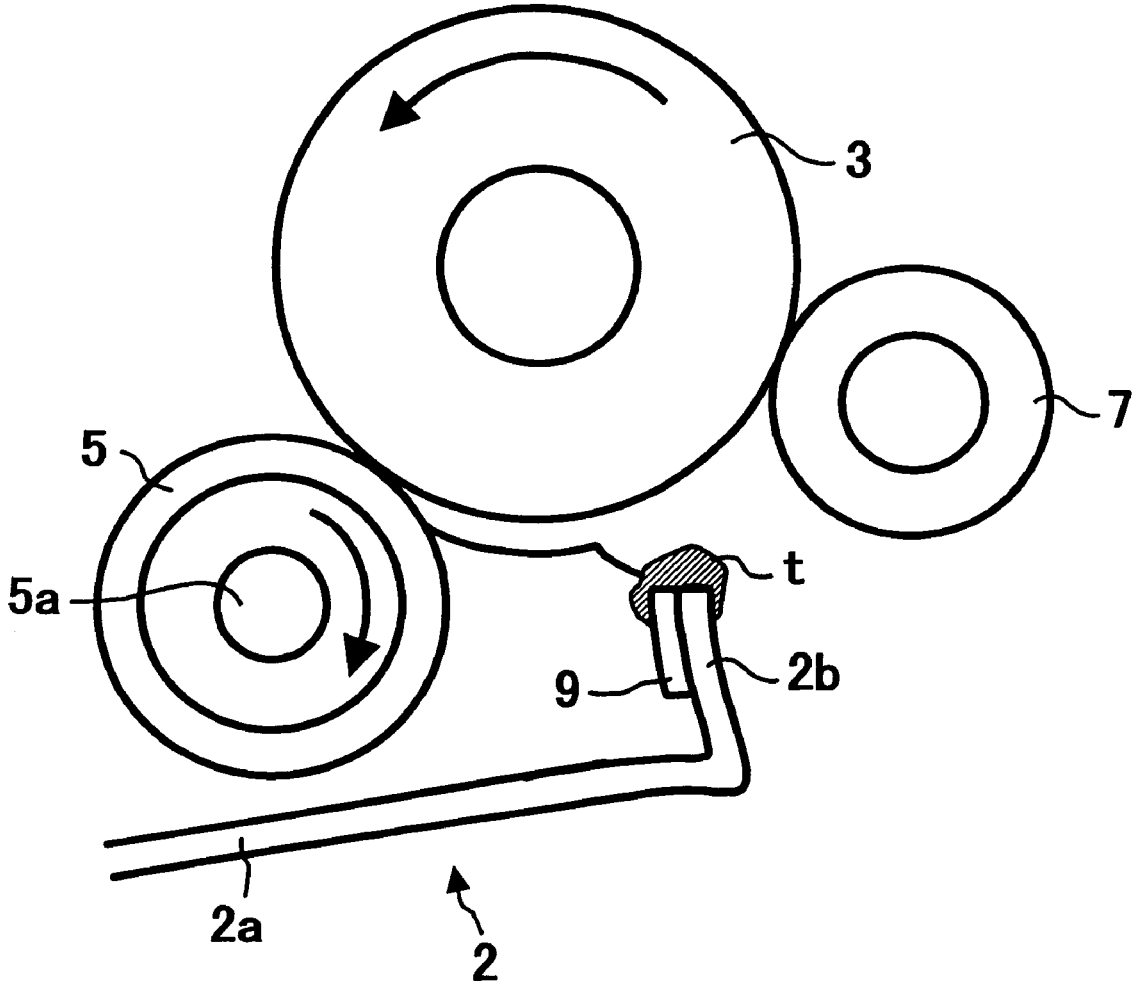
FIG. 15 PRIOR ART
FIG. 15 is an explanatory view of a state that a toner is adhered to a case portion of the process cartridge in the known laser printer.

When the non-conductive member 44 is provided to the case portion 30*b* side of the conductive member 40, by placing the tip end of the non-conductive member 44 closer to the image carrier 10 than the tip end of the conductive member 40, as illustrated in FIG. 9, it is possible not only make the transfer material P not to contact the conductive member 40 but also to prevent the electric charge round the non-conductive member 44, and thereby to completely prevent the charge of the transfer material P, thus impeding the lowering of the image quality.

In the embodiment described above, the description has been made for a case where "a portion of a case close to the surface of the image carrier 10 after development and before transfer of an image" is a part of the cartridge case 30 of the process cartridge 32. However, the case portion is not limited to such part of a process cartridge but may instead be part of a developing case of the developing device or part of other components of the apparatus.

According to the present invention, as described above, a magnet is provided to a portion of a case close to the surface of an image carrier after development and before transfer of an image. Therefore, a floating toner scattered from the image carrier and the developing roller can be magnetically held by the magnetic force of the magnet, and thereby the toner can be prevented from scattering again to the image carrier so as to lower the quality of the image, and further the toner adhered to the case portion can be prevented from flying outside of the case as a lump, thus eliminating the possibility that the transfer material is contaminated by the scattered toner and the hands are contaminated by the toner.

Further, according to the present invention, the magnet is provided to the case portion through a conductive member and a voltage of the same polarity as that of the developer is applied to the conductive member. Therefore, it is possible to prevent much more toner from flying toward the magnet by the conductive member so as to sufficiently hold the scattered toner by the magnet, thus positively eliminating the possibility that the transfer material is contaminated by the scattered toner and the hands are contaminated by the toner.

Furthermore, the magnet is provided so that a range in which the magnet can hold the developer ranges from 0.5 to 3 mm from the tip end of the conductive member on the image carrier side. Therefore, it is possible to impede the toner held by the magnet from getting over the magnetic member to move toward the front surface side of the case portion, thus more positively eliminating the possibility that the transfer material is contaminated by the scattered toner and the hands are contaminated by the toner.

Still furthermore, according to the present invention, when X is the shortest distance between the range in which the magnet can hold the developer and the image carrier and Y is the moving linear velocity of the image carrier, the following relation is established; $X \geqq Y/100$. Therefore, it is possible to impede the toner magnetically held by the magnet from scattering again to the image carrier due to an air current caused by the rotation of the image carrier to further prevent the lowering of the quality of the image.

Further, according to the present invention, the shortest distance between the range in which the magnet can hold the developer and the image carrier is not less than 1.0 mm.

Therefore, likewise, it is possible to impede the toner magnetically held by the magnet from scattering again to the image carrier due to an air current caused by the rotation of the image carrier to further prevent the lowering of the quality of the image.

According to the present invention, a conductive member is provided, while projecting closer to the image carrier than the case portion, to the developing roller side of a case portion close to the surface of an image carrier after development and before transfer of an image, and a voltage of the same polarity as that of the developer is applied to the conductive member. Therefore, by the interruption of the projecting conductive member, the floating toner scattered from the image carrier and the developing roller is hard to get over the conductive member to adhere to the front surface side of the case portion, thus eliminating the possibility that the transfer material and the hands are contaminated with the toner.

Further, a non-conductive member is provided to the case portion side of the conductive member overlapping with each other, forming two layers. Therefore, it is possible to prevent the transfer material from coming into direct contact with or coming close to the conductive member by the interruption of the non-conductive member, so that unnecessary charge is not applied to the transfer material and thereby the lowering of the quality of an image is prevented.

In addition, according to the present invention, the overlapped conductive and non-conductive members are made such that the two-layer portion protruding from the case portion is bent by 1 mm with the bending force not less than 20 gf/cm when a transfer material comes in contact with the non-magnetic member. Therefore, it is possible to prevent the conductive member from being bent by being pressed by the transfer material, and to impede the toner from floating and scattering due to the reaction thereof when restored, thus further preventing the lowering of the quality of an image.

Numerous additional modifications and variations of the present invention are possible in light of the above teachings. It is therefore to be understood that within the scope of the appended claims, the present invention may be practiced otherwise than as specifically described herein.

The present application claims priority and contains subject matter related to Japanese Patent Applications No. 11-102466 and No. 2000-66069 filed in the Japanese Patent Office on Apr. 9, 1999 and in March of 2000, respectively, the entire contents of which are hereby incorporated by reference.

What is claimed as new and is desired to be secured by Letter Patent of the United State is:

1. An electrophotographic image forming apparatus using a magnetic toner as a developer, comprising:

an image carrier;

a case housing a developing roller to develop a latent image formed on the image carrier with the developer, wherein a magnet is provided to a portion of the case adjacent a surface of the image carrier after development of the latent image and before transfer of a developed image, and a conductive member wherein the magnet is provided on the case portion through said conductive member, and a voltage of a same polarity as that of the developer is applied to said conductive member.

2. An electrophotographic image forming apparatus according to claim 1, wherein the case portion is positioned so as to be closer to the image carrier than to the developing roller.

3. An electrophotographic image forming apparatus according to claim 1, wherein the magnet is provided so that a range in which the magnet can hold the developer is from 0.5 to 3 mm from a tip end of the conductive member on the image carrier side.

4. An electrophotographic image forming apparatus using a magnetic toner as a developer, comprising:

an image carrier; and a case housing a developing roller to develop a latent image formed on the image carrier with the developer, wherein a magnet is provided to a portion of the case adjacent a surface of the image carrier after development of the latent image and before transfer of a developed image, wherein, when a shortest distance between a range in which the magnet can hold the developer and the image carrier is X and a moving linear velocity of the image carrier is Y, meets the relationship: $X \geqq Y/100$.

5. An electrophotographic image forming apparatus using a magnetic toner as a developer, comprising:

an image carrier; and a case housing a developing roller to develop a latent image formed on the image carrier with the developer, wherein a magnet is provided to a portion of the case adjacent a surface of the image carrier after development of the latent image and before transfer of a developed image so as to hold a portion of the developer on said magnet such that a shortest distance between the developer held by said magnet and the image carrier is not less than 1.0 mm.

6. An electrophotographic image forming apparatus using a magnetic toner as a developer, comprising:

an image carrier;

a case housing a developing roller to develop a latent image formed on the image carrier with the developer;

wherein a conductive member is provided to a developing roller side of a portion of the case adjacent to a surface of the image carrier after development of the latent image and before transfer of the developed image, projecting closer to the image carrier than the case portion, and a voltage of a same polarity as that of the developer is applied to the conductive member;

a non-conductive member provided at a case portion side of the conductive member so as to overlap with the conductive member, wherein the overlapped and non-conductive members are made such that a portion of the overlapped and non-conductive members protruding from the case portion is bent by 1 mm with a bending force of 20 gf/cm or more when a transfer material comes in contact with the non-conductive member.

7. A process cartridge for an electrophotographic image forming apparatus, comprising:

an image carrier; and a developing device for developing an electrostatic latent image on the image carrier using a magnetic toner as a developer, wherein a magnet is provided at a portion of a case of the process cartridge adjacent to a surface of the image carrier after development of the latent image and before transfer of the developed image, wherein the magnet is provided on the case portion through a conductive member and a voltage of a same polarity as that of the developer is applied to the conductive member.

8. A process cartridge according to claim 7, wherein the case portion is positioned closer to the image carrier than to the developing roller.

9. A process cartridge according to claim 7, wherein the magnet is provided so that a range in which the magnet can hold the developer ranges from 0.5 to 3 mm from a tip end of the conductive member on a side of the image carrier side.

10. A process cartridge according to claim 7, wherein a shortest distance between a range in which the magnet can hold the developer and the image carrier is not less than 1.0 mm.

11. A process cartridge for an electrophotographic image forming apparatus, comprising:

an image carrier; and a developing device for developing an electrostatic latent image on the image carrier using a magnetic toner as a developer, wherein a magnet is provided at a portion of a case of the process cartridge adjacent to a surface of the image carrier after development of the latent image and before transfer of the developed image wherein, when a shortest distance between a range in which the magnet can hold the developer and the image carrier is X and a moving linear velocity of the image carrier is Y, a following relationship is established: $X \geqq Y/100$.

12. A process cartridge for an electrophotographic image forming apparatus having an image carrier; and a developing device for developing an electrostatic latent image on the image carrier using a magnetic toner as a developer, the process comprising providing a conductive member at a developing roller side of a portion of a case of the process cartridge adjacent to a surface of the image carrier after development of the latent image and before transfer of the developed image, projecting closer to the image carrier than the case portion, and a voltage of a same polarity as that of the developer is applied to the conductive member wherein a non-conductive member is provided to a case portion side of the conductive member so as to overlap with the conductive member and wherein the overlapped conductive and non-conductive members are made such that a portion of the overlapped conductive and non-conductive members protruding from the case portion is bent by 1 mm with a bending force of at least 20 gf/cm when a transfer material comes in contact with the non-conductive member.

13. A process of making a process cartridge for an electrophotographic image forming apparatus, the process cartridge including an image carrier and a developing device for developing an electrostatic latent image on the image carrier using a magnetic toner as a developer, the process comprising the step of;

providing a conductive member and a magnet to a portion of a case of the process cartridge adjacent to a surface of the image carrier after development of the latent image and before transfer of the developed image;

providing a non-conductive member at a case portion side of the conductive member; and protruding a portion of the conductive and non-conductive members from the case portion so as to bend under a bending force of at least 20 gf/cm when a transfer material comes in contact with the non-conductive member.

* * * * *